US009771756B1

(12) United States Patent
Gregoire

(10) Patent No.: US 9,771,756 B1
(45) Date of Patent: Sep. 26, 2017

(54) LADDER FOOTING APPARATUS

(71) Applicant: Matthew Gregoire, Woonsocket, RI (US)

(72) Inventor: Matthew Gregoire, Woonsocket, RI (US)

( * ) Notice: Subject to any disclaimer, the term of this patent is extended or adjusted under 35 U.S.C. 154(b) by 0 days.

(21) Appl. No.: 15/090,030

(22) Filed: Apr. 4, 2016

Related U.S. Application Data

(60) Provisional application No. 62/142,674, filed on Apr. 3, 2015, provisional application No. 62/143,943, filed on Apr. 7, 2015.

(51) Int. Cl.

| | |
|---|---|
| ***E06C 7/42*** | (2006.01) |
| ***E06C 7/50*** | (2006.01) |
| ***E06C 7/18*** | (2006.01) |
| ***E06C 7/46*** | (2006.01) |

(52) U.S. Cl.
CPC ..... *E06C 7/42* (2013.01); *E06C 7/188* (2013.01); *E06C 7/46* (2013.01); *E06C 7/505* (2013.01)

(58) Field of Classification Search
CPC ... E06C 7/42; E06C 7/423; E06C 7/44; E06C 7/46; E06C 7/188; E06C 7/18; E06C 7/00
See application file for complete search history.

(56) References Cited

U.S. PATENT DOCUMENTS 530,374 A * 12/1894 Wilkins ..... E06C 7/48 182/107
776,446 A * 11/1904 Williamson ..... E06C 7/46 182/107
846,228 A * 3/1907 Miller ..... E06C 1/22 182/167
1,412,582 A * 4/1922 Vaile ..... A63B 61/04 411/457
1,427,889 A * 9/1922 Wittmann ..... B60B 39/12 135/118
1,710,026 A * 4/1929 McCormick ..... E06C 7/16 182/107
1,982,572 A * 11/1934 Colglazier ..... E06C 1/36 182/107
2,319,893 A * 5/1943 Tuttle ..... E04G 5/00 182/129
2,523,535 A * 9/1950 Little ..... E06C 7/46 182/107
4,007,807 A * 2/1977 Pogwizd ..... E06C 7/46 182/109
4,121,692 A * 10/1978 Morawski ..... E06C 7/48 182/129
4,164,269 A * 8/1979 Jackson ..... E06C 7/48 182/107
4,331,217 A * 5/1982 Stecklow ..... E06C 7/48 182/107

(Continued)

*Primary Examiner* — Daniel Cahn
(74) *Attorney, Agent, or Firm* — Salter & Michaelson

(57) ABSTRACT

A ladder footing apparatus for supporting the base of a ladder, wherein the ladder is being positioned against a first wall structure at a top end of the ladder. The ladder footing apparatus includes an elongated handle having respective one and other opposed ends, a resilient pad member supported at one end of the elongated handle, the resilient pad member for engaging a second wall structure that is in opposed position to said first wall structure, and a hook member supported at the other opposed end of the elongated handle, said hook member for engaging a lower rung of the ladder.

15 Claims, 12 Drawing Sheets

(56) References Cited

U.S. PATENT DOCUMENTS 4,446,945 A * 5/1984 Anderson ..... B66F 1/02 182/214
4,598,795 A * 7/1986 Larson ..... E06C 7/12 182/129
4,941,547 A * 7/1990 Livick ..... E06C 7/16 182/107
5,054,579 A * 10/1991 Moson ..... E06C 7/46 182/107
5,337,856 A * 8/1994 Fillers ..... E06C 7/46 182/107
5,647,452 A * 7/1997 Gauthier ..... E06C 7/16 182/107
5,890,560 A * 4/1999 Sloop ..... E06C 1/34 182/107
5,918,699 A * 7/1999 Summers ..... E06C 7/46 182/107
5,950,760 A * 9/1999 Morrison ..... B63B 57/00 182/148
6,053,284 A * 4/2000 Fountain ..... E06C 7/423 182/180.2
6,089,350 A * 7/2000 Hankins ..... E06C 7/46 182/107
6,105,722 A * 8/2000 Taylor ..... E06C 7/42 182/107
6,152,261 A * 11/2000 Hoey ..... E06C 7/48 182/107
6,199,660 B1 * 3/2001 Meeks ..... A01M 31/02 182/116
6,955,243 B1 * 10/2005 Huff ..... E06C 7/46 182/107
7,163,084 B1 * 1/2007 Blehm ..... E06C 7/423 182/172
7,293,630 B1 * 11/2007 Trebec ..... E06C 7/423 182/172
7,437,854 B1 * 10/2008 O'Reilly ..... E04H 1/1216 4/449
7,445,086 B1 * 11/2008 Sizemore ..... E06C 7/081 182/107
8,047,330 B1 * 11/2011 English ..... E06C 7/48 182/117
8,464,834 B2 * 6/2013 Blazin ..... E06C 7/06 182/107
9,038,778 B1 * 5/2015 Carter ..... A01M 31/02 182/115
D733,325 S * 6/2015 Robinson, Jr. ..... D25/68
9,109,371 B2 * 8/2015 Hudson ..... E04G 3/26
2001/0035313 A1 * 11/2001 Uridel ..... E06C 7/44 182/107
2007/0289812 A1 * 12/2007 Feemster ..... E06C 7/46 182/107
2008/0230663 A1 * 9/2008 Svehlek ..... E06C 7/48 248/211
2009/0200110 A1 * 8/2009 Esselborn ..... E06C 7/46 182/107
2010/0051384 A1 * 3/2010 Currie ..... E06C 7/46 182/107
2010/0213003 A1 * 8/2010 Svehlek ..... A62B 35/0062 182/3
2011/0017549 A1 * 1/2011 Lietz ..... E06C 1/06 182/172
2011/0100752 A1 * 5/2011 Donlon ..... E06C 7/42 182/107
2011/0114418 A1 * 5/2011 Blazin ..... E06C 7/06 182/129
2011/0290587 A1 * 12/2011 Blazin ..... E06C 7/188 182/107
2013/0068560 A1 * 3/2013 Estep ..... E06C 7/188 182/107
2015/0047924 A1 * 2/2015 Graham, Sr. ..... E06C 7/188 182/107
2015/0345219 A1 * 12/2015 Aoi ..... E06C 1/18 182/176
2016/0153234 A1 * 6/2016 Mazanek ..... E06C 7/06 182/129

* cited by examiner

LADDER FOOTING APPARATUS

RELATED CASES

Priority for this application is hereby claimed under 35 U.S.C. §119(e) to commonly owned and U.S. Provisional Patent Application Nos. 62/142,674 which was filed on Apr. 3, 2015 and 62/143,943 which was filed on Apr. 7, 2015 and each of which is incorporated by reference herein in its entirety.

FIELD OF THE INVENTION

The present invention relates in general to a ladder foot apparatus and pertains more particularly, to such an apparatus that can be used indoors or outdoors but preferably is for indoor use.

BACKGROUND AND SUMMARY OF THE INVENTION

The public makes extensive use of ladders even for indoors use. One of the problems associated with the ladder is the proper support of the ladder so that it does not tumble over or otherwise get dislodged. Accordingly, it is an object of the present invention to provide an accessory for use with a ladder and to support the bottom end of the ladder so that the ladder can be stationery as it leans against a sidewall. The apparatus of the present invention preferably is in the form of an elongated handle with a hook member at one end for engagement with a rung of the ladder and a support pad at the opposite end for engagement with an opposed wall or other object. The handle is preferably extendable with appropriate means for telescoping sections of the handle. Part of the hook end of the handle comprises a support bar that can also function as an alternate rung or step.

In accordance with the present invention there is provided a ladder footing apparatus for supporting the base of a ladder, said ladder being positioned against a first wall structure at a top end of the ladder. The ladder footing apparatus comprises; an elongated handle having respective one and other opposed ends, a resilient pad member supported at one end of the elongated handle, the resilient pad member for engaging a second wall structure that is in opposed position to said first wall structure, and a hook member supported at the other opposed end of the elongated handle, said hook member for engaging a lower rung of the ladder.

In accordance with other aspects of the present invention the handle includes an adjustment piece disposed along the length of the handle to adjust the length of the handle; the hook member includes at least one hook supported from a base piece; the base piece comprises an auxiliary step that is disposed forward of the at least one hook; the auxiliary step is substantially triangular having a wider end that is integral with the hook; the hook comprises an open hook with plural sidewalls formed into a U-shape that engages against a rung; the U-shape is formed by five sidewalls including a center sidewall attached with the handle and a pair of outer sidewalls that extend about the rung; the resilient pad member comprises a rigid substrate plate and a resilient pad mounted to the rigid substrate plate; the resilient pad member comprises a rigid substrate plate and a resilient pad mounted to the rigid substrate plate; including a pivot on the rigid substrate plate for attachment with the handle to enable the handle shaft to assume different angular positions relative to the ladder; in combination with a stabilizer piece that forms the second wall structure; the stabilizer piece has opposed end flanges that define an open slot into which the resilient pad member is slid; and the stabilizer piece includes a top bar that is supported by a pair of spaced apart legs that are meant to engage with a ground surface.

In accordance with another version of the present invention there is provided a ladder stabilizing kit that is comprised of:

(A) a ladder footing apparatus that is comprised of an elongated handle having respective one and other opposed ends, a resilient pad member supported at the one end of the elongated handle, and a hook member supported at the other opposed end of the elongated handle; and (B) a stabilizer piece that is meant for planting in a ground surface and for support of the resilient pad member.

In accordance with other aspects of the present invention the handle includes an adjustment piece disposed along the length of the handle to adjust the length of the handle, and wherein the hook member includes at least one hook supported from a base piece; the base piece comprises an auxiliary step that is disposed forward of the at least one hook and wherein the auxiliary step is substantially triangular having a wider end that is integral with the hook; the stabilizer piece includes a top bar that is supported by a pair of spaced apart legs that are meant to engage with a ground surface; and the stabilizer piece has opposed end flanges that define an open slot into which the resilient pad member is slid, and a bottom lip upon which the resilient pad member rests.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Reference is now made to the drawings for one embodiment of the ladder footing apparatus of the present invention. A first embodiment is illustrated in FIGS. 1-11 and an alternate embodiment illustrated in FIG. 12. The alternate embodiment of FIG. 12 essentially provides a separate auxiliary rung or step for assisting in using the ladder. Also, FIGS. 7-11 illustrate the ladder footing apparatus of the present invention as engaged with a stabilizer piece.

Figure 6:
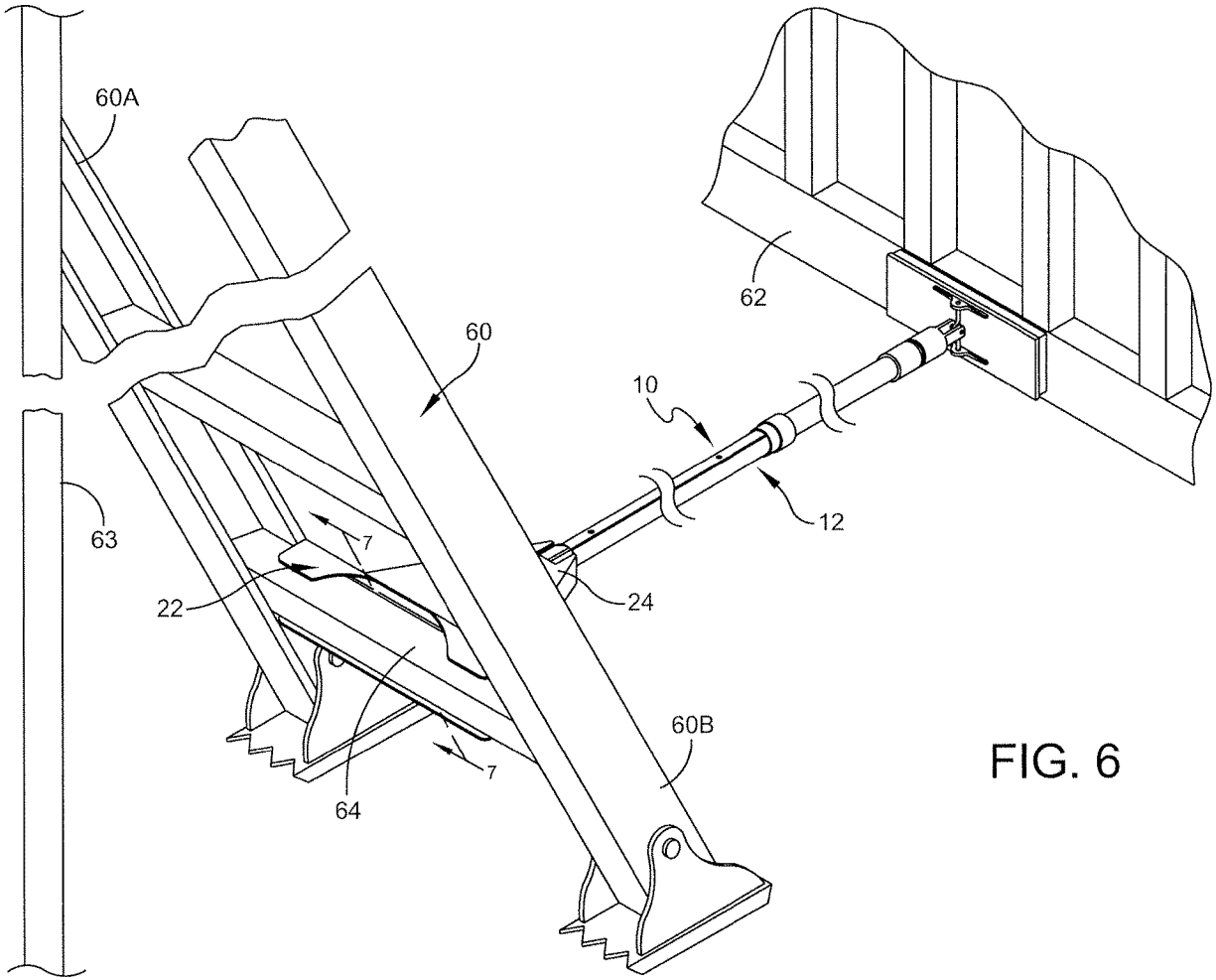
FIG. 6 is an illustration of the use of the ladder footing apparatus of the present invention secured at one end of the ladder and another end at a support wall.
Figure 8:
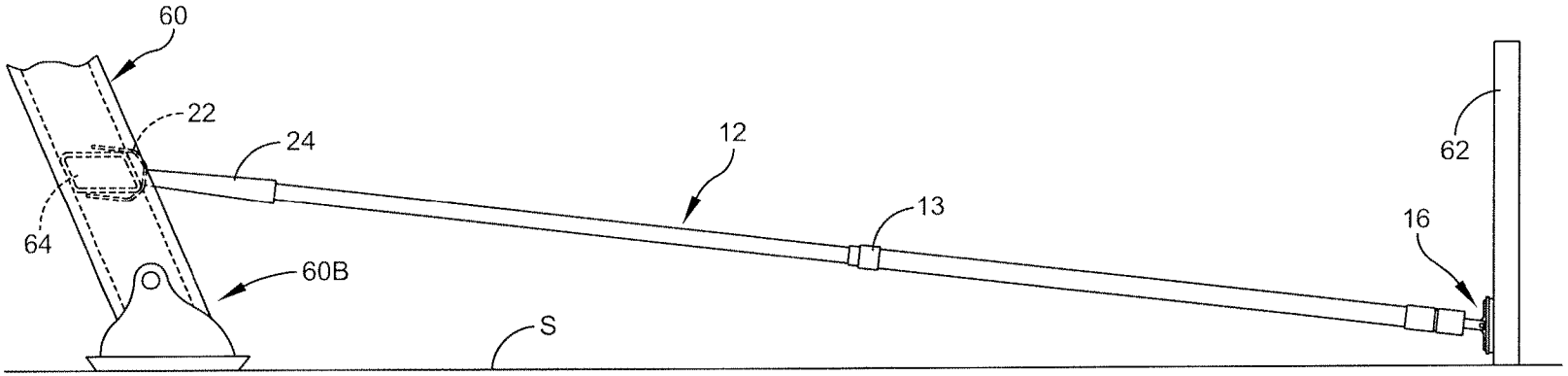
FIG. 8 is a side elevation view of the ladder footing apparatus of the present invention.

For the use of the apparatus of the present invention indoors, it is common to be able to have the ladder resting against one sidewall and having an opposite sidewall of some type for retaining the ladder footing apparatus of the present invention. In this regard, reference may be made to FIG. 6 showing the ladder footing apparatus 10 as engaged against a wall surface indicated at 62. If one was trying to stabilize the ladder for use outdoors, the sidewall 62 could be a section of stationary decking. Refer also to FIG. 8 that shows a sidewall at 62. Refer also to the side elevation of FIG. 11 wherein the ladder may be stabilized for outdoor use by means of the stabilizer piece 40 that can be engaged in a ground surface.

Figure 4:
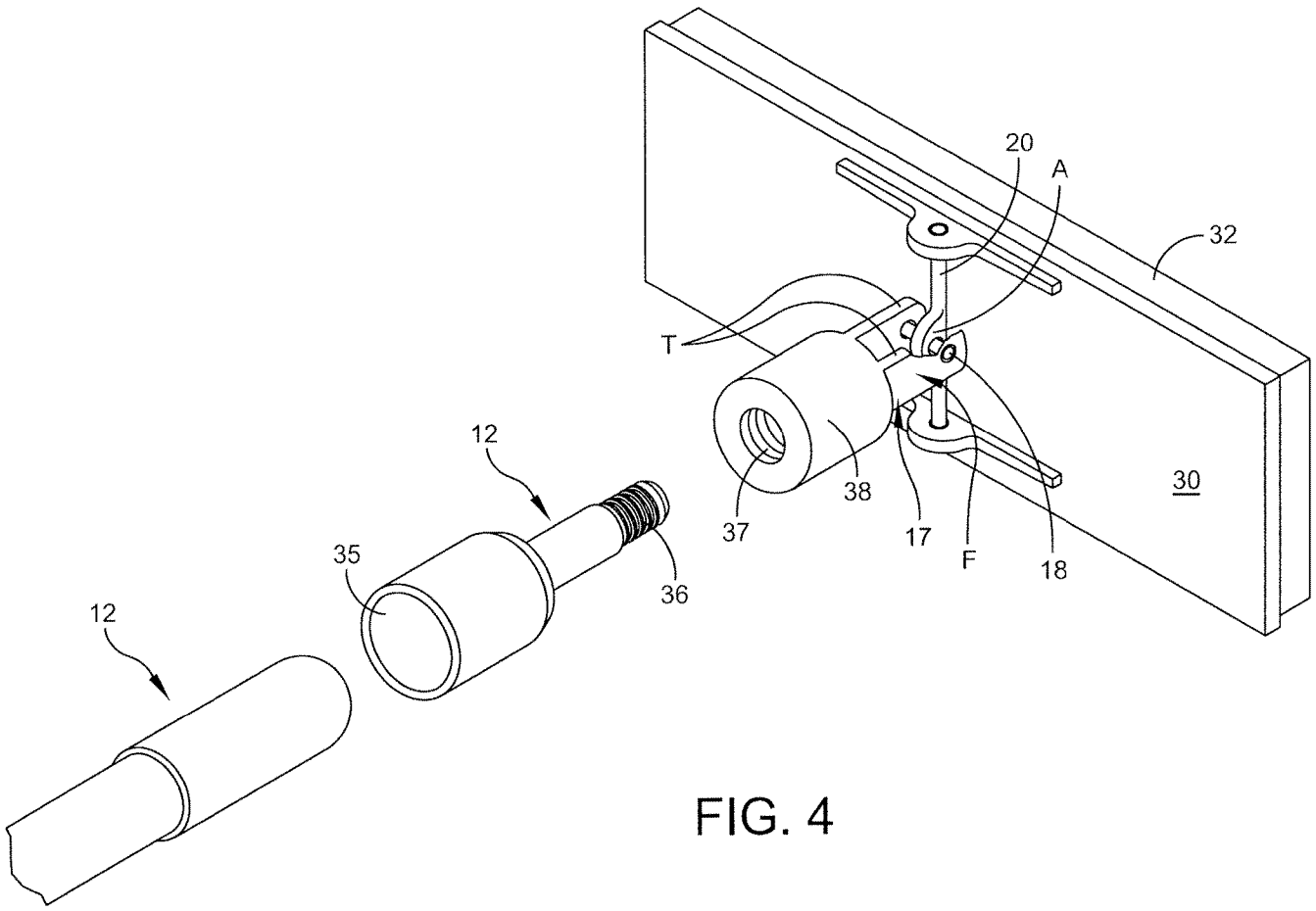
FIG. 4 is a perspective view similar to that shown in FIG. 3 and showing further details of the connection between the handle and the resilient pad.
Figure 5:
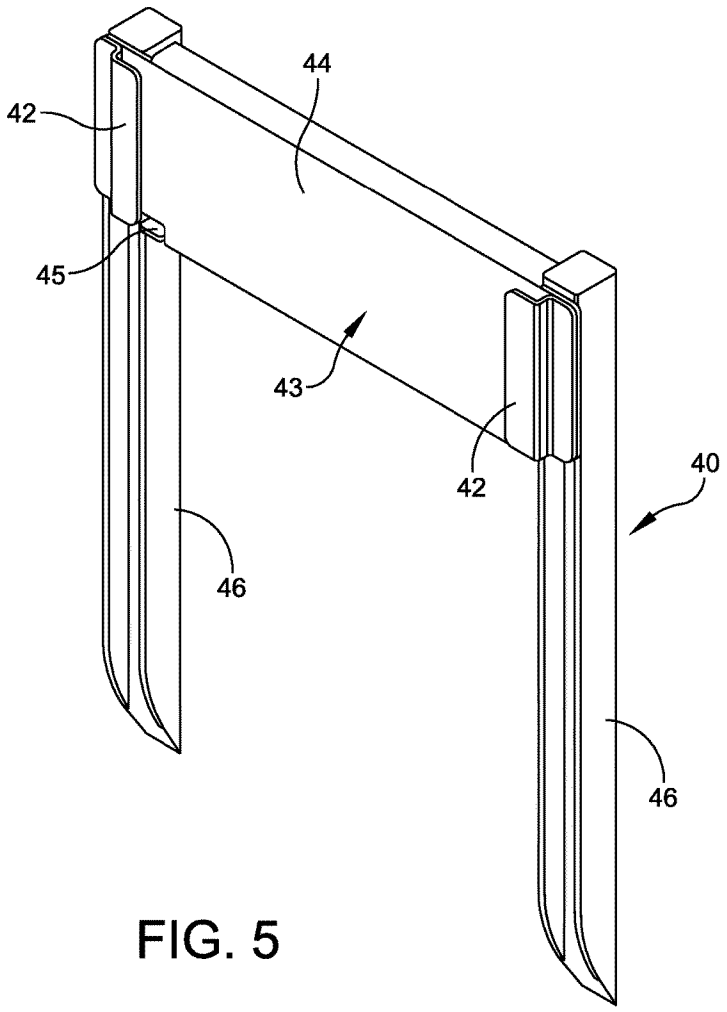
FIG. 5 is a perspective view of the stabilizer piece used with the present invention.

The ladder footing apparatus is used for supporting the base of a ladder which is typically positioned against a first wall structure such as at 63 illustrated in FIG. 6. It is the top end 60A of the ladder 60 that is positioned at this first wall structure 63. The ladder 60 also has a bottom end 60B that is supported on the rest surface S. In this regard, refer to FIGS. 6 and 8. FIG. 6 illustrates the top end 60A of the ladder that rests on the first wall structure 63. FIG. 8 illustrates the bottom 60B of the ladder 60 supported on the rest surface S. The ladder footing apparatus of the present invention is comprised of an elongated handle that is basically in the form of a pole. This handle is illustrated at 12 in the drawings. Associated with the handle 12 is an adjustment member 13. The handle 12 is preferably adjustable to different lengths and in this regard may include a telescoping section. One end of the handle, as illustrated at 15 in FIG. 2A, is mated with the hook member 21. The other end of the handle 12, such as illustrated in FIG. 4, may be engaged with a post 38 having an internally threaded passageway at 37. The end of the handle 12 may be engaged with a coupling 34 open at 35 and threaded at 36 for engagement with the threaded aperture 37. The opening 35 engages against an end of the pole 12 and may be permanently affixed thereto. In this way, the handle 12 is adjustable in length and once adjusted to a desired length, is secured such as by means of the securing or adjustment member 13. The telescoping nature and the adjustment and securing of the handle may be by means well known to one skilled in the art.

The ladder footing apparatus of the present invention also includes a resilient pad member 16 that is supported at one end of the elongated handle. The resilient pad member 16 is for engaging a second wall structure such as illustrated by way of example in FIG. 6 or FIG. 8 with the structure 62 representing a second wall structure. This second wall structure is usually arranged in opposed position to the first wall structure.

Figure 7:
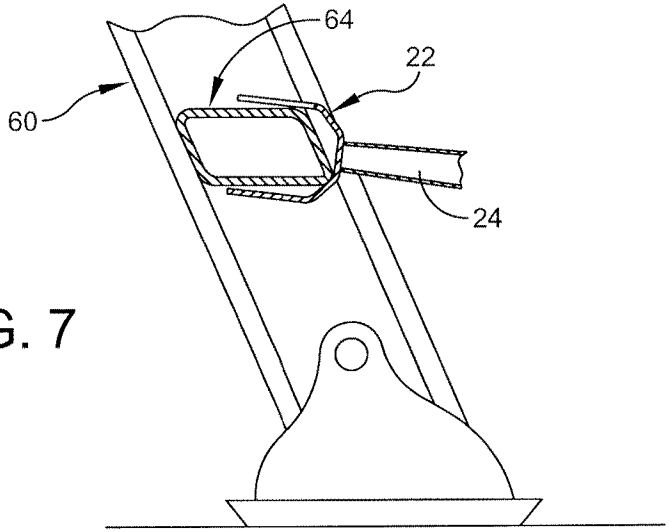
FIG. 7 is a fragmentary view that is partially cross-sectioned showing the engagement between the hook member and the rung of the ladder.
Figure 11:
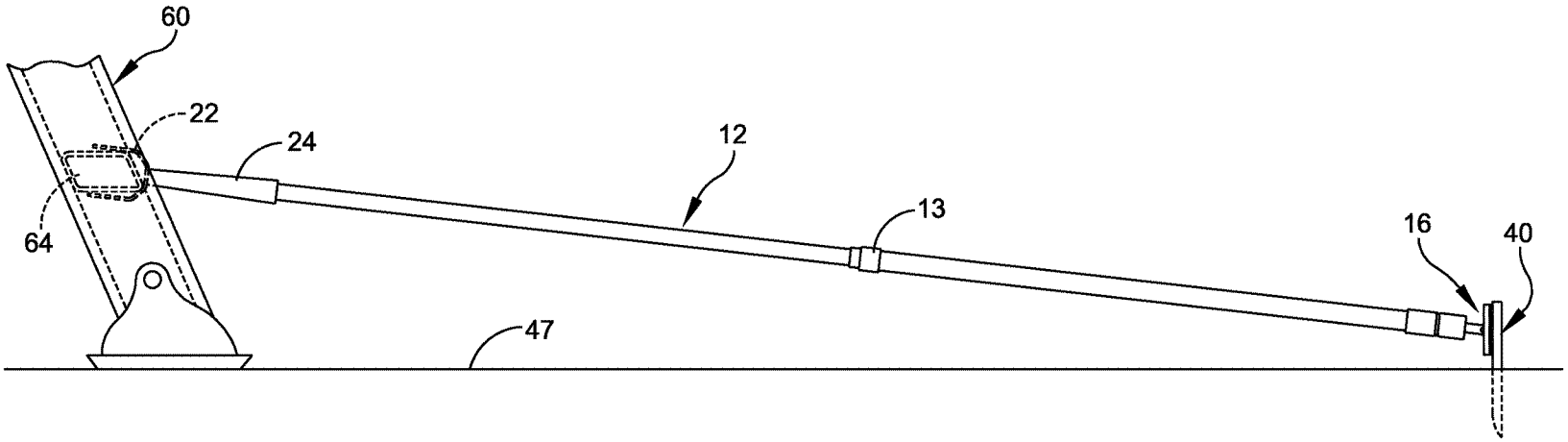
FIG. 11 is a side elevation view of the ladder footing apparatus of the present invention engaged with the stabilizer piece.

The ladder footing apparatus of the present invention also includes a hook member 41 supported at the other opposed end of the elongated handle. This hook member is for engaging a lower rung of the ladder. In this regard, reference may be made to, for example, FIG. 6 showing the hook member 22 engaged with the rung 64 of the ladder 60. Refer also to FIGS. 7, 8 and 11 showing the manner in which the hook member engages with the rung of the ladder. This engagement is preferably with the lowermost rung of the ladder, although it may also be engaged with a rung above the lowermost rung.

Figure 3:
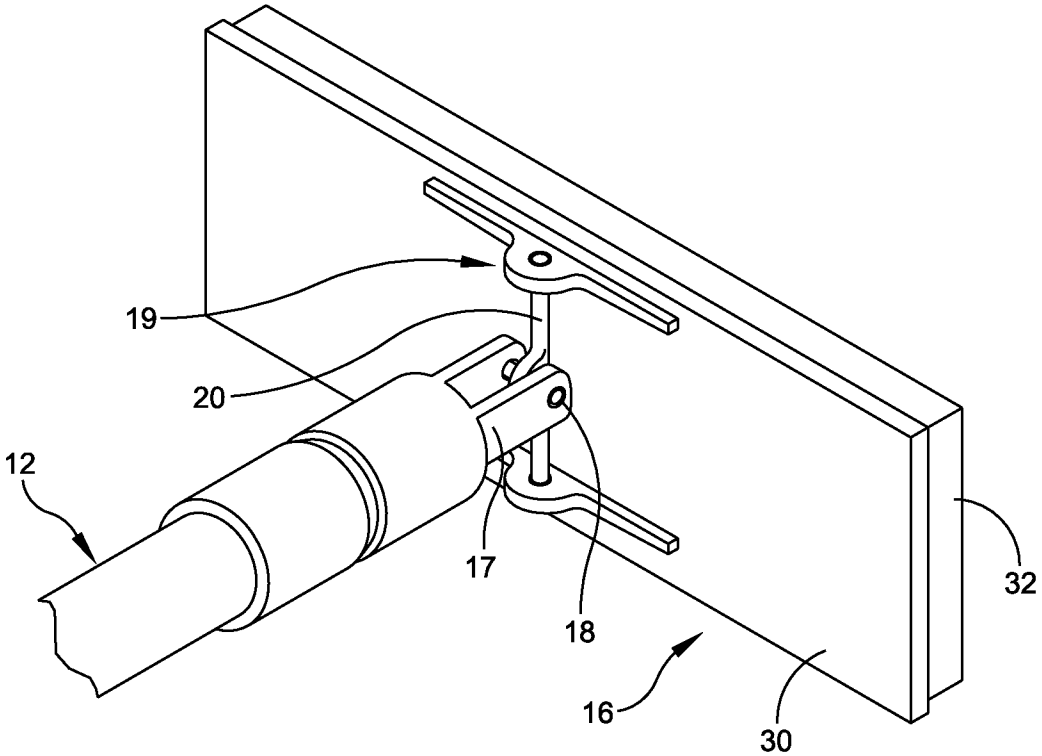
FIG. 3 is a perspective view taken at the pad end of the apparatus.

The resilient pad member comprises a rigid substrate 30. This may be in the form of a rectangular rigid plate member. The resilient pad member 16 also includes a resilient pad 32 that is fixedly mounted to the substrate 30. Between the end of the handle 12 and the resilient pad member there is provided a pivot. This enables the angle of the handle relative to the pad member to be secured at different angles dependent upon the distance between the ladder and the second wall structure. In this regard refer to FIGS. 3 and 4 illustrating the end of the handle having a pivot section 17 that carries a pivot pin 18. The pivot section 17 includes a forked piece F having two tines T. The pivot pin 18 passes through an aperture A in the rod 20. The rod 20 forms part of a pivot mechanism 19 that is secured to the backside of the rigid substrate plate 30.

Figure 2:
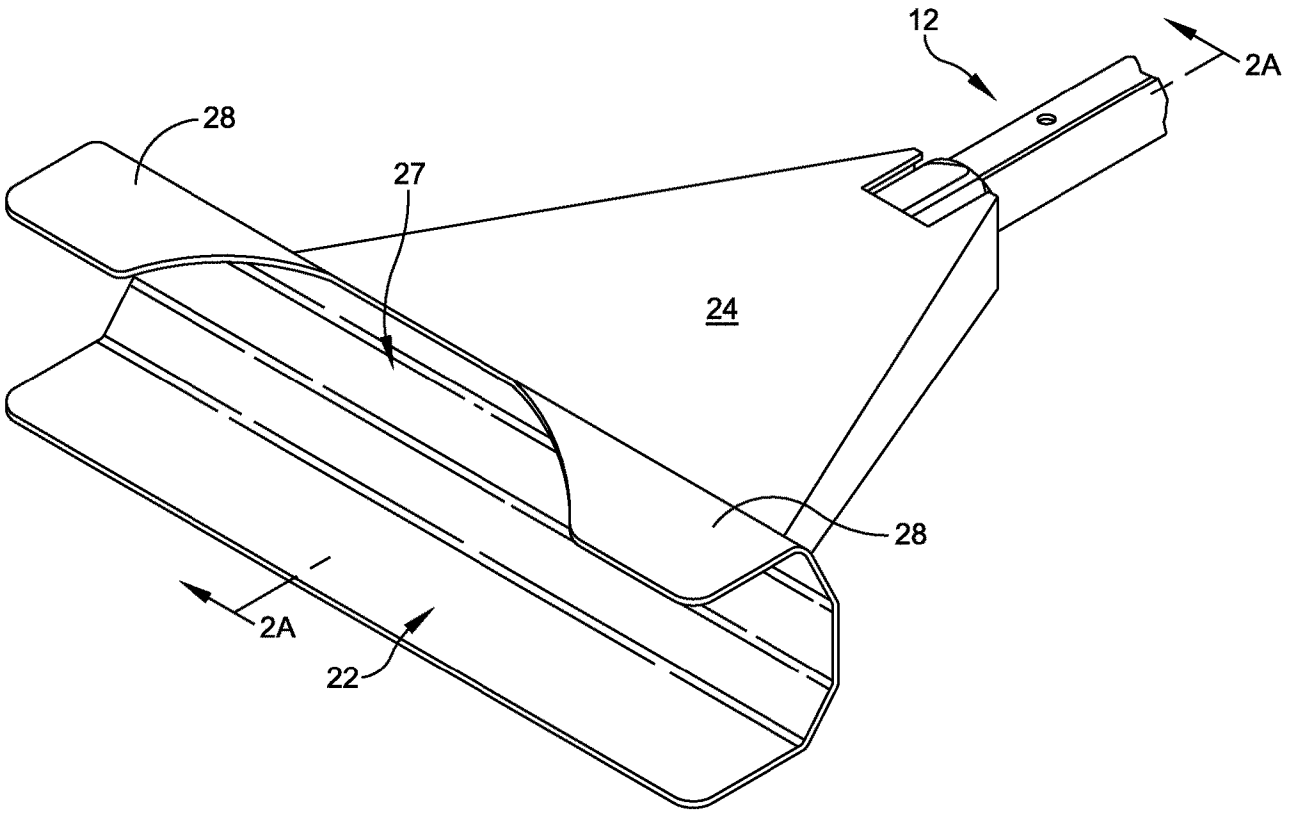
FIG. 2 is a perspective view at the hook member used for engaging a ladder rung.
Figure 2A:
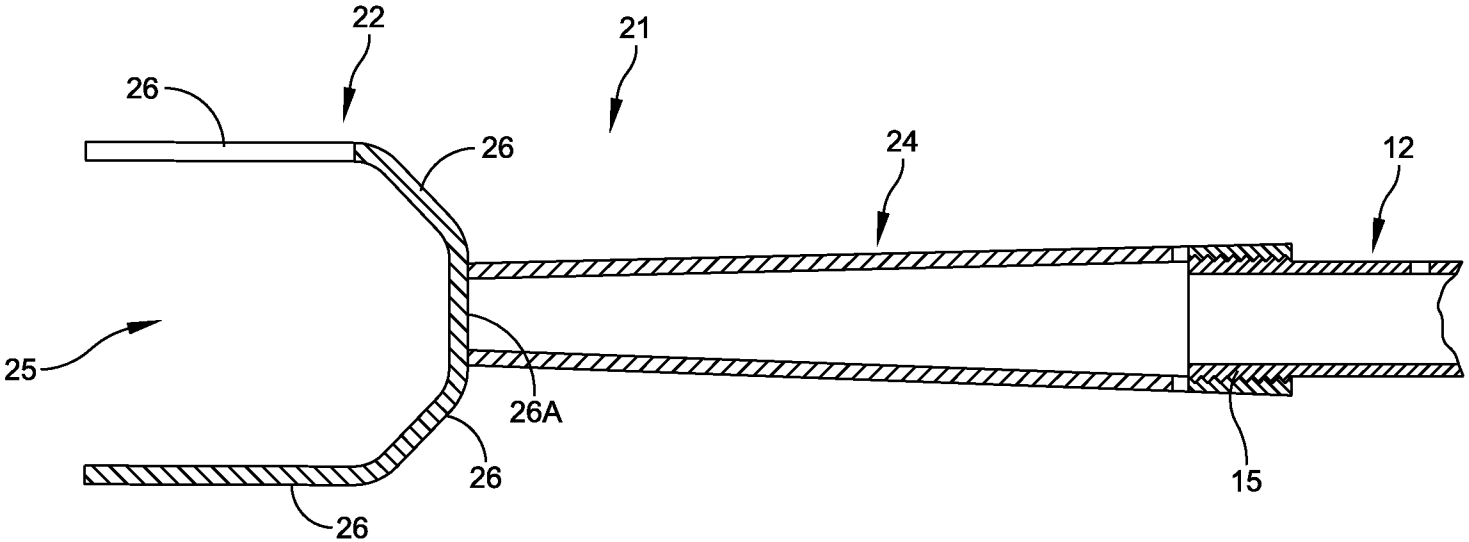
FIG. 2A is a cross-section view taken along line 2A-2A of FIG. 2

The hook member 21 such as illustrated in FIGS. 2 and 2A comprises an open hook 22 that is comprised of plural sidewalls 26 that are formed into an essentially U-shaped structure that is adapted to engage against a rung such as shown in FIGS. 7 and 8. In the embodiment that is described, such as in FIG. 2A, the U-shaped structure is formed by five sidewalls 26 including a center sidewall 26A that is attached with the handle. This also includes a pair of outer sidewalls that extend about the ring. In the embodiment of FIG. 2A there are actually two sidewalls 26 above and below the center sidewall 26A.

Also, and as illustrated in FIG. 2, the hook 22 may be provided with an opening 27 formed between end pieces 28. This arrangement is helpful in locating the hook member about the rung as the opening 27 provides for a viewing of the rung relative to the hook member.

As indicated previously, particularly for use outdoors, there may not be a convenient second wall structure and thus one of the important components of the present invention is the use of a stabilizer piece 40 such as illustrated in FIGS. 5 and 9-11. See in particular the side elevation view of FIG. 11 with the stabilizer piece 40 inserted into a ground surface 47 to essentially lock the stabilizer piece in place. By doing that the ladder footing apparatus has a fixed location and is thus essentially anchored at that location preventing the ladder from any movement.

Figure 9:
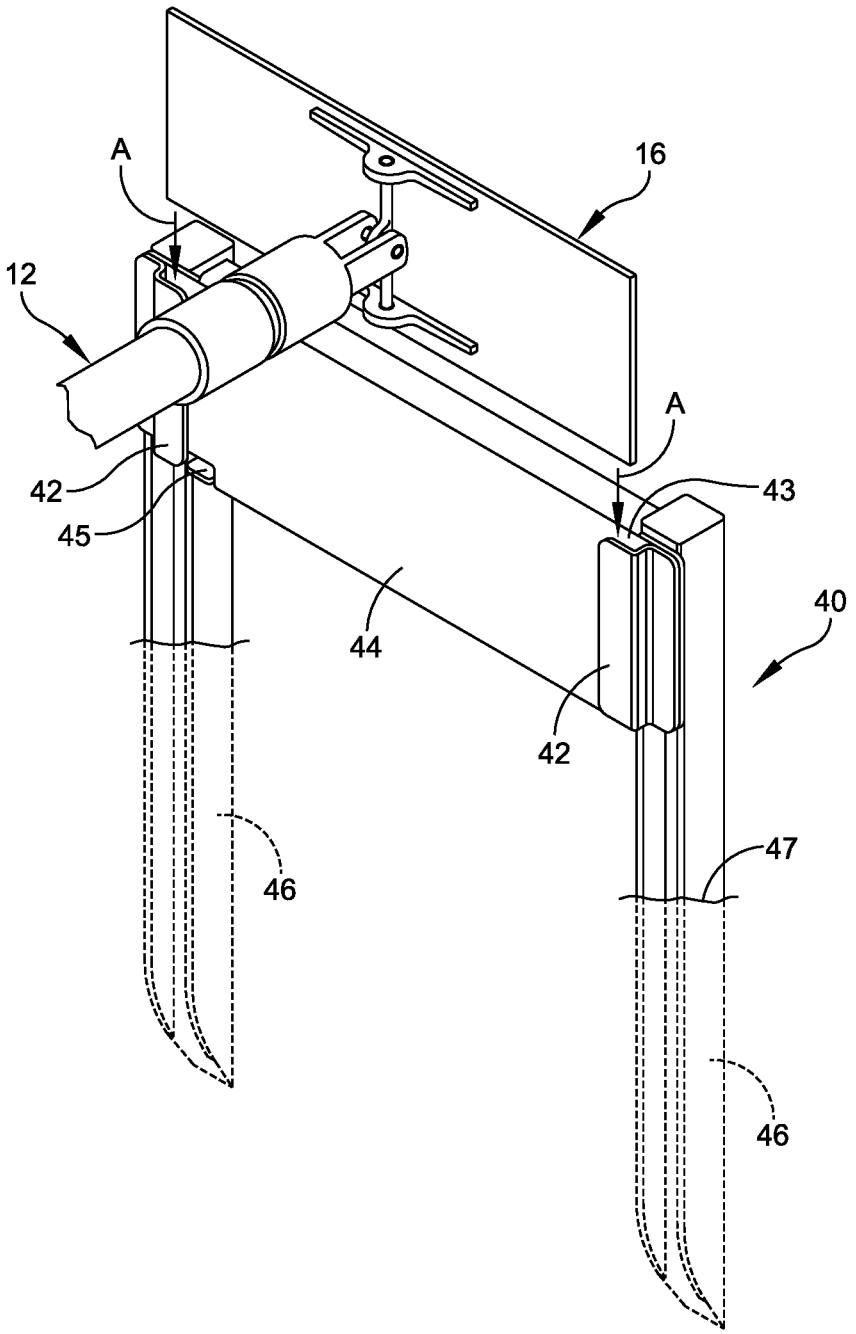
FIG. 9 is a perspective view showing the stabilizer piece as engaged in a ground surface.
Figure 10:
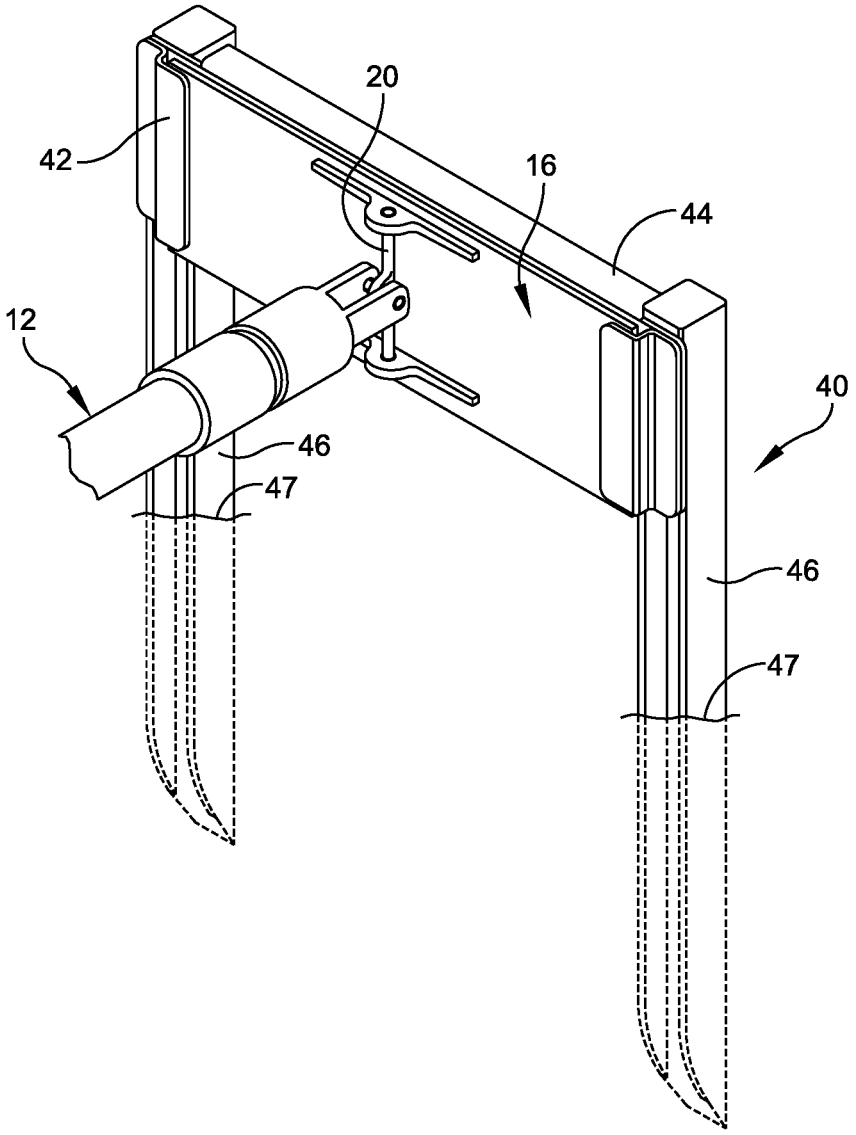
FIG. 10 is a perspective view similar to that shown in FIG. 9 with the pad engaged with the stabilizer apparatus.

The stabilizer piece thus essentially forms a second walls structure. The stabilizer piece has opposed end flanges 42 that define an open slot 43 into which the resilient pad member may be slid. FIG. 9 illustrates the resilient pad member 16 positioned over the slot 43. In FIG. 9 arrows A indicate the manner in which the resilient pad member 16 may be slid into the slot 43. Refer also to FIG. 10 that shows the pad member 16 in place secured with the stabilizer piece.

The stabilizer piece in addition to including the end flanges 42 also includes a top bar 44 that is formed integrally with a pair of downwardly depending legs 46 that are for engagement with the ground surface. The top bar 44 may be secured to the legs in any one of a number of different ways. As also illustrated in FIG. 9, there are preferably a pair of bottom lips 45 upon which the resilient pad member rests. One of these lips is shown in FIG. 9 and it would be another lip position similarly associated with the opposed position flange 42.

Another aspect of the present invention is the use of a ladder footing apparatus kit. This kit is preferably comprised of:

(A) a ladder footing apparatus that is comprised of an elongated handle having respective one and other opposed ends, a resilient pad member supported at the one end of the elongated handle, and a hook member supported at the other opposed end of the elongated handle; and (B) a stabilizer piece that is meant for planting in a ground surface and for support of the resilient pad member.

Thus, one can provide a kit that is basically comprised of the ladder footing device as well as the stabilizer piece. In that way, one can use the ladder footing device without the stabilizer piece as long as there is access to a second wall structure. On the other hand, particularly for out of doors use, the stabilizing piece can be engaged with a ground surface for providing the stabilization that is necessary for the ladder footing device of the present invention.

Figure 12:
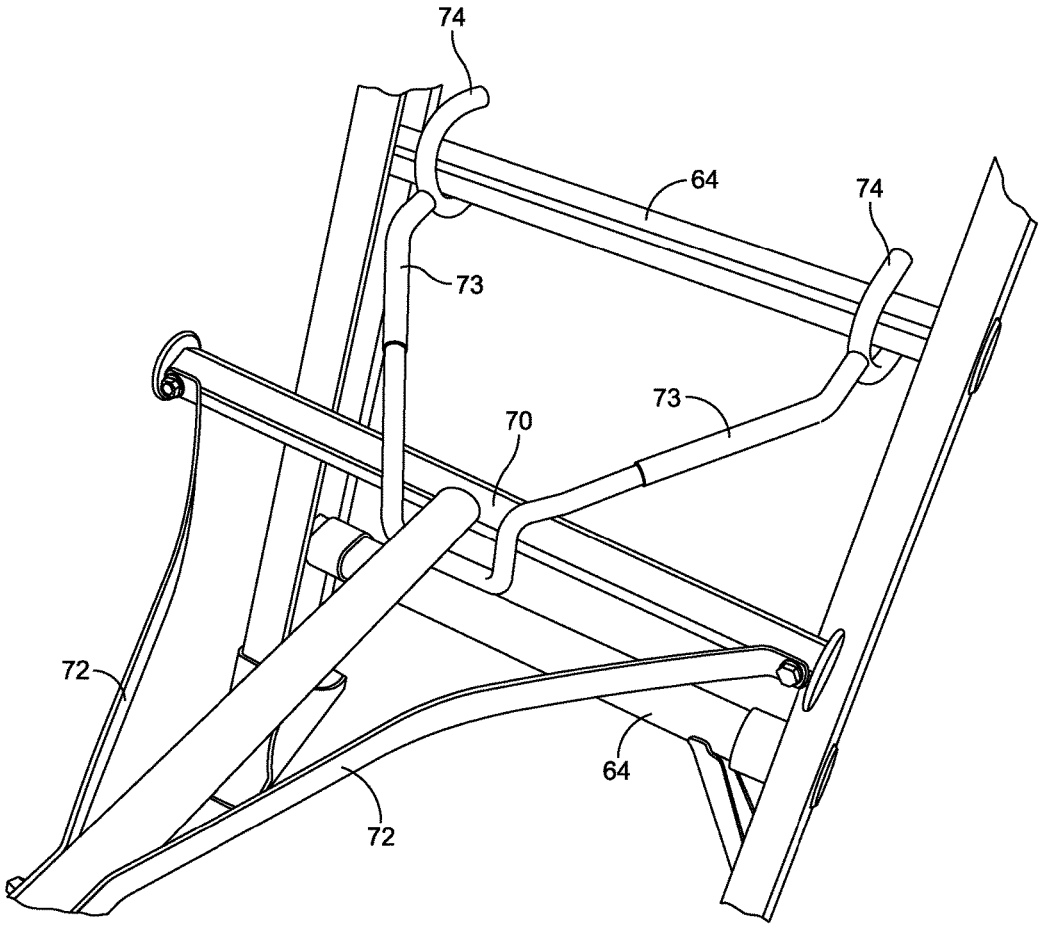
FIG. 12 is a perspective view of an alternate embodiment of the present invention.

The perspective view of FIG. 12 shows an arrangement in which a different hook member is provided. This is comprised of a pair of hooks 74 that are engaged with a rung 64 that is not necessarily a bottom rung of the ladder. In this embodiment at the hook end of the device, there is provided a cross bar 70 attached at the end of the handle. A pair of side legs 72 assist in supporting the bar 70 from the handle. Around the middle of the bar 70 there are provided angled pieces 73 that extend to and support the respective hooks 74. One of the advantages of this embodiment is that the bar 70 can also function as an auxiliary rung or step while the apparatus is fixed in position. The auxiliary step 70 is disposed forward of the ladder structure.

Figure 1:
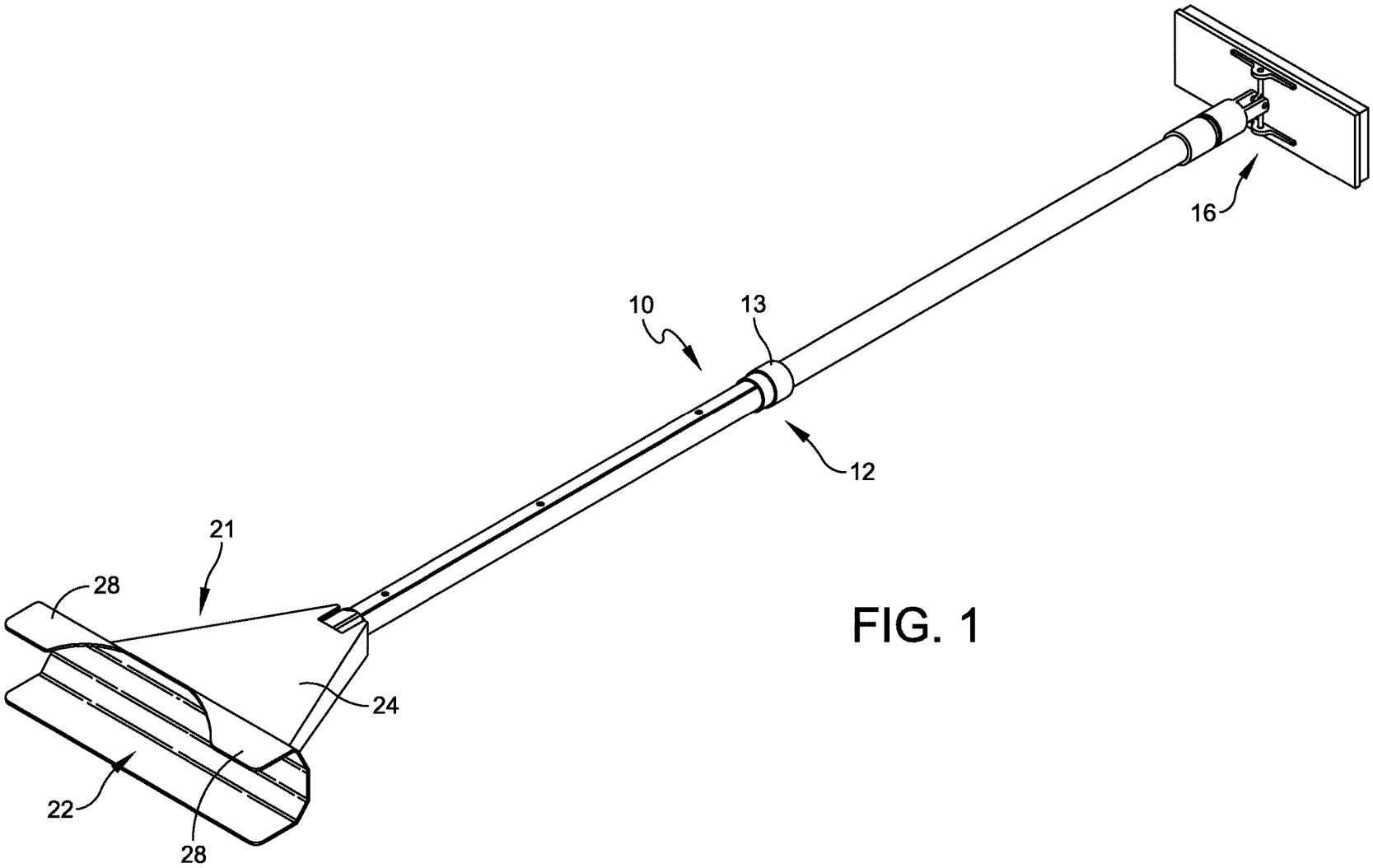
FIG. 1 is a perspective view of one embodiment of the ladder footing apparatus of the present invention.

A similar step may also be provided in the embodiment illustrated in FIGS. 1-3. This is provided by means of the triangular base piece 24 that provides a sufficient surface area and that may be stepped upon to assist one in using the ladder. FIG. 8, for example, illustrates the triangular base piece at 24 which would provide a sufficient surface area for stepping on to the ladder to assist the user of the ladder.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A combination of a ladder footing apparatus, a ladder, a first vertical wall structure and a stabilizer piece, wherein said ladder footing apparatus is configured to support the ladder, the combination comprising:

said ladder having a set of spaced apart side rails directly connected by a plurality of parallel spaced apart ladder rungs, the ladder having a bottom end and a top end, wherein the top end rests against the first vertical wall structure as a major length of the side rails extends angularly away from the vertical wall structure so that the bottom end of the ladder is configured to be supported on a rest surface at a position spaced away from the vertical wall structure;

said ladder footing apparatus comprising a major length of a telescoping handle having a first end and a second opposite end configured to extend and retract with respect to each other along the major length of the handle, a substantially rigid plate of a pad member supported by the second end of the elongated handle by a pivot mechanism, said pivot mechanism having a major length of a pivot pin extending substantially orthogonal to a major length of a rod having an aperture in which the pivot pin extends through, a hook member having a U-shaped hook with an opening configured to receive and engage a lower rung of the plurality of rungs of the ladder, wherein the hook member is supported on the first end by way of a base piece providing an auxiliary step configured to be stepped upon by a user, and wherein the pad member is configured to removably slide into the stabilizer piece in order to selectively move the pad member between a first position and a second position, wherein the first position is when the pad member is supported in the stabilizer piece at a spaced height above the rest surface, and the second position is when the pad member is supported by a second vertical wall structure at a second spaced height above the rest surface;

said stabilizer piece having a horizontal top bar, opposed end flanges that define an open slot configured to slidably receive and secure opposite edges of the rigid plate therein, and at least one leg directly connected substantially orthogonally to the horizontal top bar so that the at least one leg is configured to penetrate into the rest surface in order to secure the stabilizer piece into a vertical position allowing the rigid plate to be secured in the open slot a spaced distance above of the rest surface;

wherein the bottom end of the ladder is positioned between, and spaced apart from, the first vertical wall structure and the stabilizer piece, and the ladder footing apparatus is directly connecting the lower rung of the ladder to the stabilizer piece in order to provide resistance against movement of the ladder in a direction away from the first vertical wall structure which is towards the stabilizer piece.

2. The combination of claim 1 wherein the telescoping handle includes an adjustment piece disposed along the major length of the handle to adjust the major length of the handle.

3. The combination of claim 1 wherein the at least one leg comprises a pair of spaced apart legs for engagement with the rest surface.

4. The combination of claim 3 wherein the auxiliary step is disposed forward of the U-shaped hook.

5. The combination of claim 4 wherein the auxiliary step has a wider end that is integral with the U-shaped hook.

6. The combination of claim 5 wherein the U-shaped hook comprises sidewalls.

7. The combination of claim 6 wherein the sidewalls comprise five sidewalk including a center sidewall attached with the handle and a pair of outer sidewalls that extend about the lower rung, and wherein the outer sidewalls have at least one end section with an opening.

8. The combination of claim 7 wherein the pad member comprises a resilient pad mounted to the rigid plate.

9. The combination of claim 3 wherein the pad member comprises a resilient pad mounted to the rigid plate.

10. The combination of claim 9 wherein the rod is attached on the rigid plate for attachment with the handle to enable the handle to have different angular positions relative to the ladder, wherein said pivot phi extends in a direction that is substantially parallel to the rigid plate.

11. The combination of claim 1 wherein the stabilizer piece has a bottom lip upon which the pad member rests.

12. The combination of claim 1 wherein the rod is secured to the pad member and the pivot pin is mounted to the support rod.

13. The combination of claim 12 wherein the rigid plate is planar and the pivot pin is secured to the rod so that the pivot pin extends in a direction that is substantially parallel to the rigid plate.

14. The combination of claim 13 wherein the second end of the elongated handle includes a forked piece having tines, and wherein said pivot pin is mounted between the tines of the forked piece.

15. The combination of claim 14 wherein the aperture of the rod is disposed between ends of the rod.

* * * * *